US005203792A

United States Patent [19]

Kaiser

[11] Patent Number: 5,203,792

[45] Date of Patent: Apr. 20, 1993

[54] SHOE CONSTRUCTION AND METHOD OF MAKING THE SAME

[75] Inventor: Emilio Kaiser, Florence, Italy

[73] Assignee: What's What, Inc., Edison, N.J.

[21] Appl. No.: 570,530

[22] Filed: Aug. 21, 1990

Related U.S. Application Data

[62] Division of Ser. No. 451,084, Dec. 15, 1989, abandoned.

[51] Int. Cl.[5] ..... A43B 9/08; A43B 9/00

[52] U.S. Cl. ..... 12/142 C; 12/142 G; 36/18; 36/12

[58] Field of Search ..... 36/12, 18, 17 R, 17 PW, 36/32 R; 12/142 RS, 142 T, 142 C, 142 G

[56] References Cited

U.S. PATENT DOCUMENTS

| | | | |
|---|---|---|---|
| 342,752 | 5/1886 | Kenton | 36/18 |
| 1,262,026 | 4/1918 | Dillberg | 12/142 G |
| 2,011,230 | 8/1935 | Mondl | 36/18 |
| 2,614,342 | 10/1952 | Hoza | 36/32 R |
| 2,930,149 | 3/1960 | Hack et al. | 36/32 R |
| 3,129,520 | 4/1964 | Funck | 36/28 |
| 4,505,055 | 3/1985 | Bergmans | 36/18 |
| 4,620,495 | 11/1986 | Ganon | 36/12 |
| 4,899,412 | 2/1990 | Ganon | 36/12 |

FOREIGN PATENT DOCUMENTS

| | | | |
|---|---|---|---|
| 981144 | 5/1951 | France | 36/18 |
| 1138834 | 6/1957 | France | 36/18 |
| 376872 | 11/1939 | Italy | 36/32 R |
| 3501 | of 1878 | United Kingdom | 36/18 |
| 191652 | 6/1923 | United Kingdom | 36/18 |
| 263461 | 12/1926 | United Kingdom | 36/18 |
| 365986 | 1/1932 | United Kingdom | 36/32 R |
| 403574 | 12/1933 | United Kingdom | 36/18 |

*Primary Examiner*—Steven N. Meyers
*Attorney, Agent, or Firm*—Kenyon & Kenyon

[57] ABSTRACT

A sole having a top surface a bottom surface and a lip extending about the perimeter of the top surface and a shoe upper having a lower edge generally configured to conform with the configuration of the lip are provided. The upper is fit, right side in, about the sole such that the upper circumscribes the lip of the sole. Then the upper is secured to the outer wall of the lip. The inner wall of the lip is folded inwardly and attached to the top surface of the sole. The upper is progressively pulled over the sole so that the upper is right side out.

7 Claims, 3 Drawing Sheets

SHOE CONSTRUCTION AND METHOD OF MAKING THE SAME

This application is a division, of application Ser. No. 07/451,084, filed Dec. 15, 1989, now abandoned.

FIELD OF THE INVENTION

The present invention relates to a shoe and a method of making the same.

BACKGROUND OF THE INVENTION

Heretofore, shoes have been manufactured using the stitch-and-turn process. Among the drawbacks of the methods of using this process is that the uppers are frequently stitched to the sole such that the toe and heel portions of a respective sole are not properly aligned with corresponding toe and heel portions of the upper. The toe portions of the soles also were not sufficiently flexible to permit turning the upper thereabout in the turning process without damaging the upper or the connection between the upper and the sole. Furthermore, the uppers were attached to the sole such that when the upper was turned right side out in the turning step, the upper did not properly stand up on its own accord and the stitching was not recessed or hidden from view.

Therefore, there is a need to provide a method of making a shoe that accurately aligns the upper about the sole and secures the upper to the sole such that after the upper is turned right side out, the upper stands up on its own accord and the stitching is recessed and hidden from view. There is a further need to provide a sole with sufficient flexibility to permit turning without damaging the upper or the connection between the upper and the sole.

SUMMARY OF THE INVENTION

The present invention is directed to a method of making a shoe that avoids the problems and disadvantages of the prior art. The present invention accomplishes this goal by making a shoe according to the steps of providing a shoe sole, having a top surface and a bottom surface, with a lip extending around the perimeter of the top surface. A shoe upper having a lower edge generally configured to conform with the configuration of the lip also is provided. The upper is fit about the sole such that the upper circumscribes the lip of the sole. The upper is secured to the lip, for example by stitching, and the inner wall of the lip is attached to the top surface of the sole. An end portion of the upper is pulled over that portion of the sole adjacent thereto so that this end portion is above the top surface of the sole and the portion of the upper opposite the end portion is below the bottom surface of the sole. Then, the portion of the upper opposite the end portion is pulled over that portion of the sole adjacent thereto so that it is above the top surface of the sole. The way in which the upper is associated with the sole ensures that once the upper is turned, the upper will stand up on its own accord and when the upper is stitched to the sole the stitching is recessed and hidden from view.

Another especially advantageous feature of the present invention is that the lip of the sole and lower edge of the upper are provided with indicia which are aligned prior to securing the upper to the lip of the sole. This permits the upper to be correctly positioned around the sole, e.g., it permits the toe portion of the upper to be properly aligned with the toe portion of the sole.

A further feature of the present invention is the provision of recesses in the top and bottom surfaces of the sole. These recesses provide the sole with sufficient flexibility to permit the upper to be turned without damage thereto or damage to the connection between the upper and the lip or the lip and the top surface of the sole.

DETAILED DESCRIPTION

Figure 1:
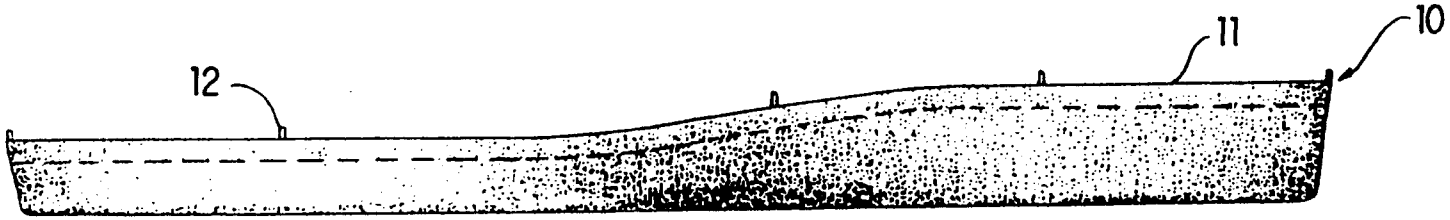
FIG. 1 is a side elevational view of the sole of the shoe in accordance with the principles of the invention.

Referring to the drawings in detail wherein like numerals indicate like elements FIG. 1 shows sole 10 for attachment to an upper in accordance with the principles of the invention.

Figure 2:
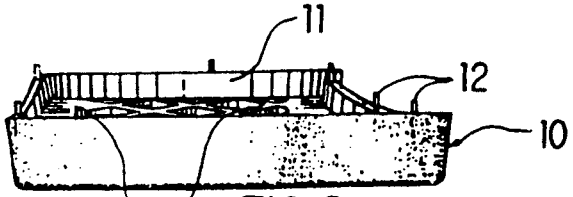
FIG. 2 is a front elevational view of the sole illustrated in FIG. 1.

As can be seen while viewing FIGS. 1 and 2, sole 10 includes rib or lip 11 which circumscribes the sole and includes nubs 12 extending therefrom. It also is apparent that the toe portion of sole 10 is thinner than the heel portion. The relatively thin toe portion provides sufficient support, as well as flexibility for turning.

Figure 3:
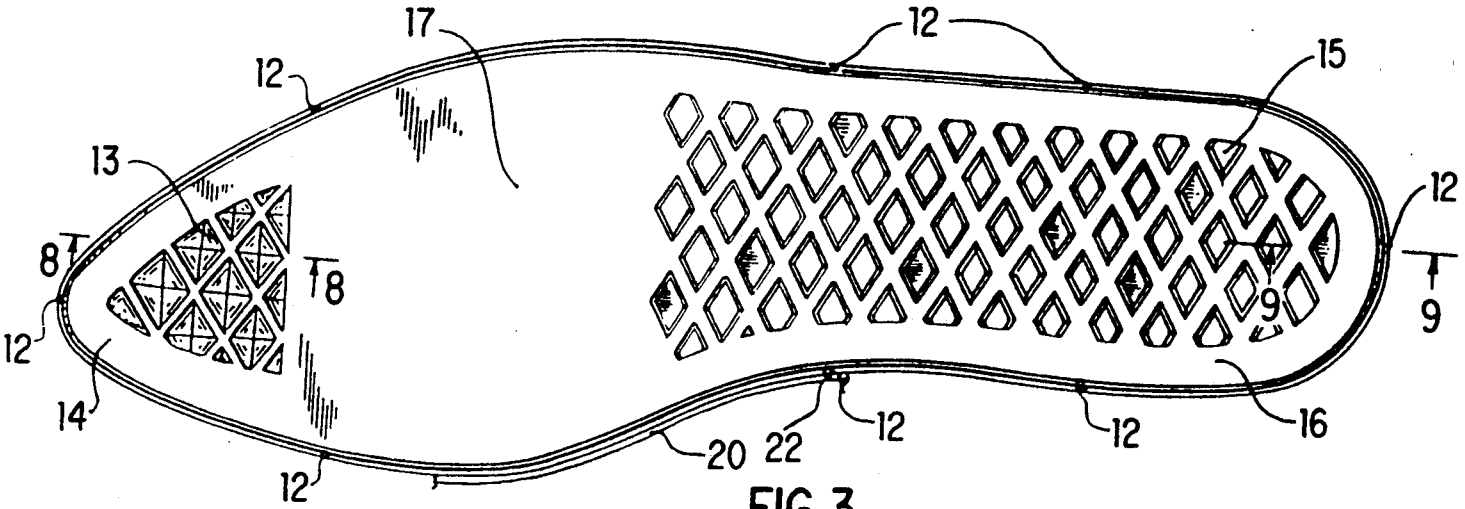
FIG. 3 is a top plan view of the sold illustrated in FIG. 1 with an upper turned inside-out stitched thereto.

Referring to FIG. 3, sole 10 includes a repeated array of rhombic elements 13 forming recesses or vacant pockets in the top side thereof in the region associated with the toe of the foot. These elements are recessed such that they form progressively smaller elements of the same shape. Band 14 of sole 10 has a smooth, essentially imperforate, construction and surrounds the rhombic elements or recesses 13.

The region associated with the heel and arch of the foot also includes a repeated array of rhombic elements 15 that form recesses or vacant pockets in the sole. However, the inner wall of elements or recesses 15 are sloped to a far lesser extent than the inner walls of elements or recesses 13 (see FIGS. 8 and 9). This set of rhombic elements is surrounded by smooth, essentially imperforate band 16. The remaining portion of the top side of the sole in the region associated with the ball of the foot, i.e., section 17, is smooth so as to provide a comfortable support for that sensitive region of the foot. More particularly, section 17, being relatively thin, does not absorb shock as well as a relatively thick section. Thus, section 17 does not include recesses because the accompanying ridges combined with the relatively thin cross-section in this region can create discomfort.

Figure 7:
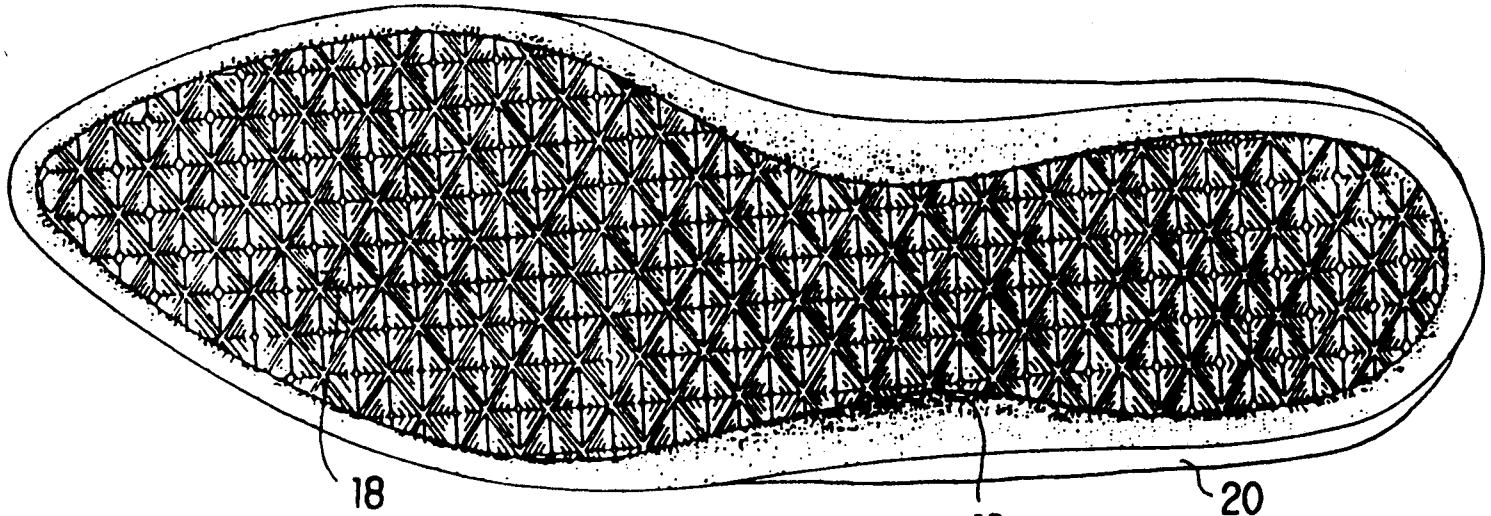
FIG. 7 is a bottom plan view of the completed shoe.
Figure 9:
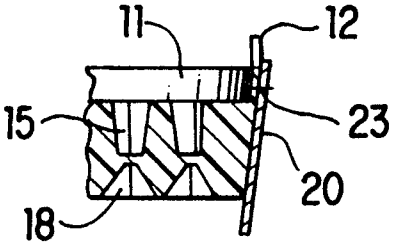
FIG. 9 is a sectional view taken along 9—9 of FIG. 3.
Figure 8:
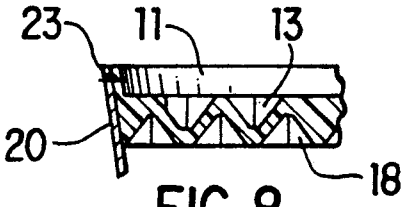
FIG. 8 is a sectional view taken along 8—8 of FIG. 3.

Referring to FIGS. 7-9, a repeated array of rhombic elements 18 essentially cover the entire bottom side of show sole 10. These elements are similar in configuration to rhombic elements 13. This region is surrounded by band 19 having a somewhat roughened surface that extends and continues into the side surfaces of the sole.

Figure 4:
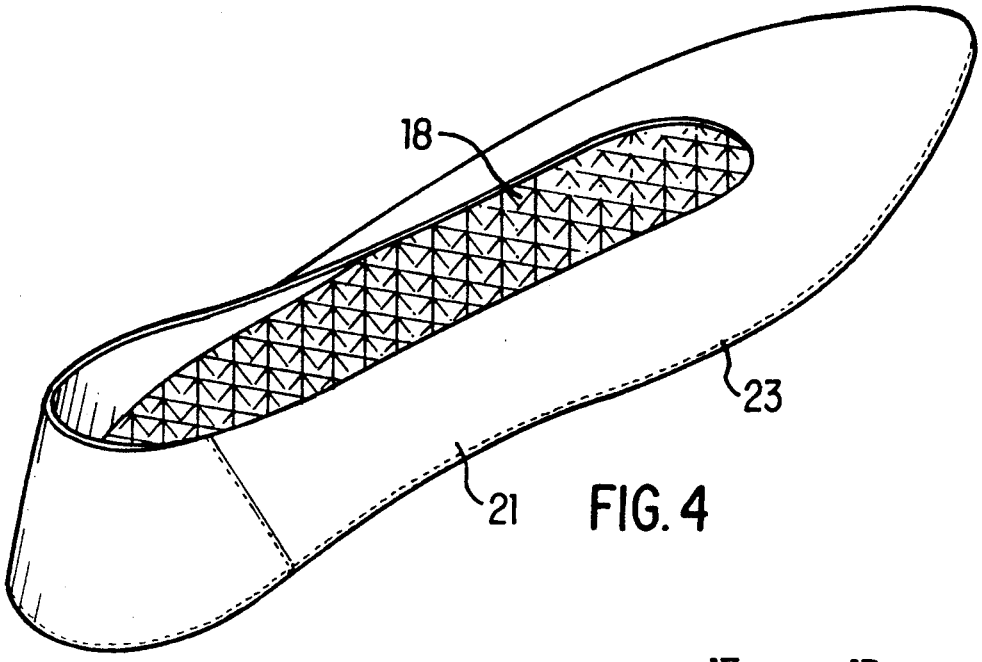
FIG. 4 is a top plan view of the sole and upper of FIG. 3 showing the lip that circumscribes the sole folded down and joined thereto.
Figure 5:
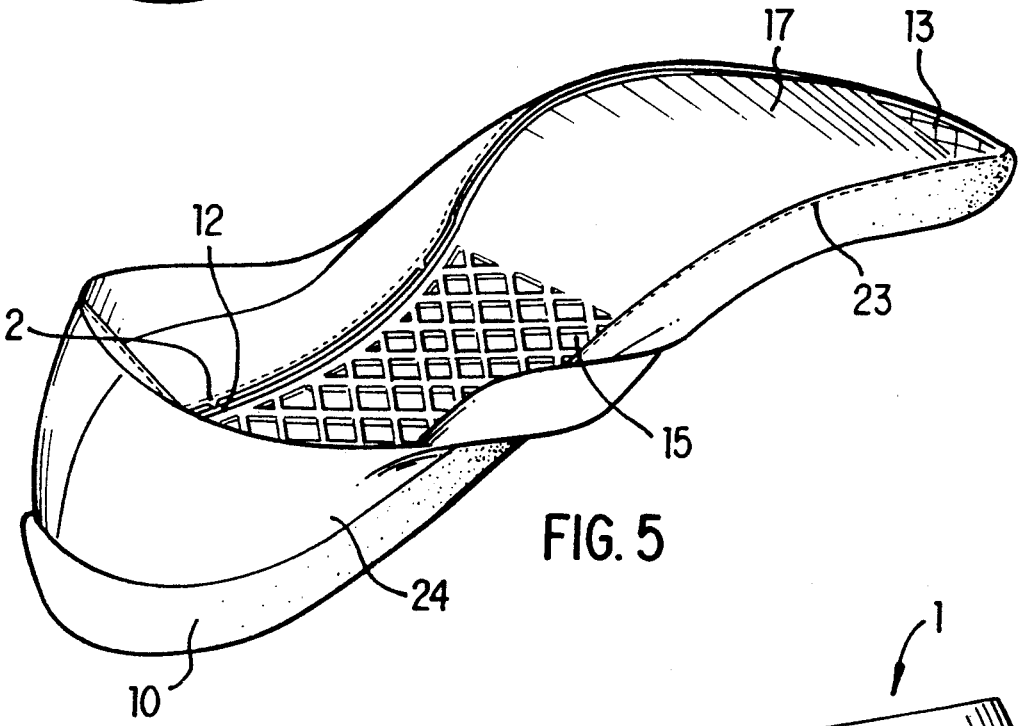
FIG. 5 illustrates the turning or righting process wherein the upper is turned right side out.

The description of the stitch and turn process to make the shoe follows with reference to FIGS. 3-6. First, upper 20, which can be leather, is placed about sole 10 such that upper 20 is inside out and the sole is upside down. Thus, the bottom of the sole is inside the upper and inside portion 21 of the upper is on the outside of this intermediate product (FIGS. 3 and 4). The upper includes indicia in the form of projections or slots 22 formed along the lower perimeter or edge of upper 20. These indicia can be formed by the cutting knife of the mold that cuts the upper. Once the lower edge of the upper is brought flush with the upper rim of lip 11, indicia 22 are positioned to correspond with nubs 12 such that corresponding portions of sole 10 an upper 20 are aligned. Thus, nubs 12 and indicia 22 Create a template fit that ensures that the sole is properly centered in the upper when the upper is stitched thereto as designated by stitching 23. In addition to the stitching, adhesive can be applied between the upper and lip 11.

Then the inner wall of lip 11 is attached, e.g., cemented, to sole 10 along the entire perimeter of sole 10 to ensure that the upper stands up on its own accord and the stitching is recessed and hidden from view after turning. More particularly, adhesive is applied along the inner wall of lip 11 or the entire periphery of the top side of sole 10 adjacent to lip 11 in such a manner to provide a continuous ring of adhesive, i.e., an adhesive ring without gaps. Then, lip 11 is folded inwardly and pressed against the top side of sole 10 along bands 14 and 16, as well as the peripheral portion of smooth section 17 to adhesively secure lip 11 to sole 10. Thus, it is important that bands 14 and 16, as well as the peripheral portion of section 17 be smooth and essentially imperforate so that the adhesive can be properly applied thereto to hold lip 11, having a width of about $\frac{1}{8}$ to $\doteq$ inch, against sole 10. One suitable adhesive is commercially available from Fasea Ltda. (Italy) as Adhesive X165.

The next step is the beginning of the turning process or righting the shoe. First, the upper is pulled over the sole so that outside portion 24 of upper 20 faces outwardly. As evident from FIG. 5, sole 10 undergoes considerable bending during the turning process. Thus, it is important that the arch, heel and toe portions of the sole include the above-described recessed portions and that section 17 and the toe portion be relatively thin to provide sole 10 with the requisite flexibility. The material that goes to make up the sole also should be selected to enhance the flexible characteristics of the sole. One sole composition which lends the desired flexibility is made from: virgin PVC 100 Kg, dioctyl phthalate 108 Kg, 3.71 Kg of stabilizing reagent (e.g., P41 reagent), styrene 0.7 Kg, blue iron oxide 0.05 Kg and black iron oxide 0.005 Kg.

The toe portion of sole 10 should be especially flexible to permit bending thereof when the upper, which substantially overlaps the toe portion of sole 10, is pulled over the toe portion during the final stage of the turning process. Both the construction of recesses 13, 18 and the relatively thin cross-section of the toe portion particularly enhance the flexibility of the toe of the sole. The depth of the vacant pockets formed by recesses 13 and 18, as well as the relationship therebetween affect flexibility. The configuration illustrated in FIG. 8 is an example of a configuration that optimizes flexibility, support and the amount of material necessary to make the sole. Furthermore, recesses 13, which are formed in the top surface of the toe portion, should cover sufficient area to substantially affect flexibility. It has been found that when recesses 13 extend over an area of the top surface of sole 10 that is at least 3 percent of the total area of the sole's top surface, adequate flexibility results.

Figure 6:
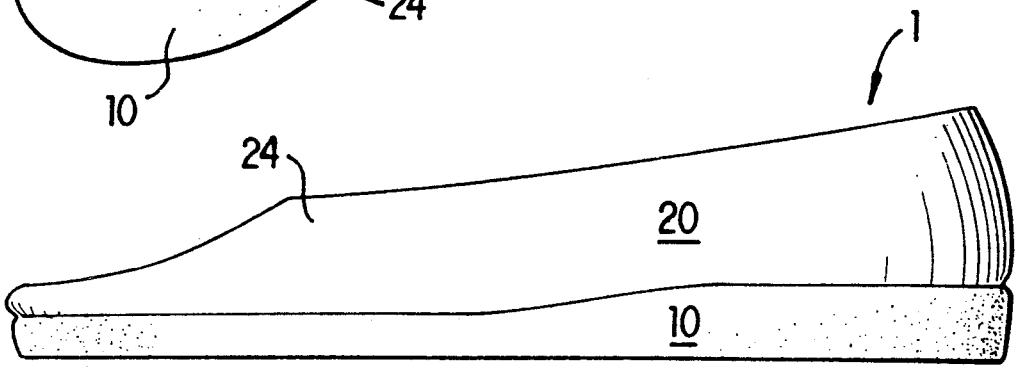
FIG. 6 is a side elevational view of the completed shoe.

Finally, the sock is laid into the bottom of the inner sole of shoe 1. The completed shoe shown in FIG. 6 illustrates the importance of folding lip 11 and the upper stitched thereto onto the top side of sole 10 and attaching it thereto. As a result of this procedure, the upper looks as though it is coming out from under the sole instead of from the side of the sole. A further advantage of this procedure is that it enables the upper to stand up, while keeping the stitching recessed and hidden from view.

Having described the invention in detail, it will be recognized that the foregoing is considered as illustrative only of the principles of the invention. Since numerous modifications and changes will readily occur to those skilled in the art, it is not desired to limit the invention to the exact construction, materials, assembly and so forth shown and described. Accordingly, all suitable modifications and equivalents may be resorted to the extent they fall within the scope of the invention and claims appended hereto.

What is claimed is:

1. A method of making a shoe comprising the steps of:

providing a shoe sole of polymeric material, having a top surface, a bottom surface and an exposed side surface, with a lip extending around the perimeter of the top surface, said lip being integrally formed with said sole as a one-piece construction, said lip having a first surface and a second surface, said lip extending upwardly from said top surface of said sole with said second surface being contiguous to and coplanar with said exposed side surface;

providing a shoe upper having a lower edge generally configured to conform with the configuration of the said lip, said shoe upper having an inside surface and an outside surface;

fitting the shoe upper inside out about the sole with the sole upside down such that the outside surface of the upper is brought flush with the lip of the sole while the lip is in the upward extending disposition;

securing the shoe upper to said lip while said lip is in the upward extending disposition;

said sole top having imperforate band extending entirely around said sole top adjacent said lip, said band being coplanar with the upper most portion of said sole top;

attaching the first surface of the lip to the top surface of the sole by applying adhesive to one of said first surface and said band;

pulling said upper over the sole so that said outside surface of said upper faces outwardly and all of the upper is above said top surface of the sole, said sole being sufficiently flexible to permit said pulling step; and said providing steps, said fitting step, said securing step, and said pulling step are being accomplished while maintaining the dimensional integrity of said sole bottom and said exposed side surface, without changing the relative position of said exposed side surface with respect to said sole bottom.

2. The method according to claim 1 wherein said polymeric material is polyvinyl chloride.

3. The method of claim 1 wherein the attaching step includes applying adhesive along the entire periphery of the top surface of said sole to provide a continuous ring of adhesive thereon, folding the entire lip inwardly and pressing it against the continuous ring of adhesive to form a continuous weld between the sole and the inner wall of the said lip.

4. The method of claim 1 wherein the attaching step includes applying adhesive along the inner wall of said lip to provide a continuous ring of adhesive thereon, folding the lip inwardly and pressing the continuous ring of adhesive against the top surface of said sole to form a continuous weld between the sole and the inner wall of said lip.

5. The method of claim 1 wherein the providing step includes having the lip extend continuously around the entire perimeter of said top surface of the sole, and the attaching step includes adhesively bonding the inner wall of said lip to said band to form a continuous weld therebetween.

6. The method of claim 1 wherein the providing step includes providing said top and bottom surfaces of the sole with recesses that form vacant pockets therein, while providing an intermediate portion of the top surface of the sole with a smooth generally imperforate surface.

7. The method of claim 1 wherein the providing step includes providing the sole with one end portion having a thickness substantially less than that of the end portion opposite thereto and providing said top and bottom surfaces of the sole, in the region of said one end portion, with recesses that form vacant pockets in the sole.

* * * * *

UNITED STATES PATENT AND TRADEMARK OFFICE

CERTIFICATE OF CORRECTION

PATENT NO. : 5,203,792

DATED : April 20, 1993

INVENTOR(S) : Emilio Kaiser

It is certified that error appears in the above-indentified patent and that said Letters Patent is hereby corrected as shown below:

IN THE ABSTRACT, line 1: After "top surface" insert --,--.

| Column | Line | Corrections |
|---|---|---|
| 2 | 16 | Change "sold" to --sole--. |
| 2 | 67 | Change "show" to --shown--. |
| 3 | 16 | Change "an" to --*and*--. |
| 3 | 17 | Change "Create" to --create--. |
| 3 | 37 | Change "1/8 to =" to --1/8 to 1/4--. |
| 4 | 25 | Change "to the extent" to --to, to the extent--. |
| 4 | 50 | Change "upper most" to --uppermost--. |

Signed and Sealed this

Twenty-fourth Day of May, 1994

*Attest:*

Bruce Lehman

BRUCE LEHMAN

*Attesting Officer*

*Commissioner of Patents and Trademarks*